United States Patent [19]

Itaya et al.

[11] Patent Number: 4,822,711

[45] Date of Patent: Apr. 18, 1989

[54] ELECTROSTATIC IMAGE-DEVELOPING PROCESS USING A MAGNETIC ROLLER

[75] Inventors: Masahiko Itaya; Hiroshi Fuma; Toshiro Fujimori, all of Hachioji, Japan

[73] Assignee: Konica Corporation, Tokyo, Japan

[21] Appl. No.: 119,155

[22] Filed: Nov. 10, 1987

[30] Foreign Application Priority Data

Nov. 12, 1986 [JP] Japan ..... 61-270212
Nov. 17, 1986 [JP] Japan ..... 61-275040

[51] Int. Cl.[4] ..... G03G 15/08
[52] U.S. Cl. ..... 430/120; 118/658
[58] Field of Search ..... 430/110, 120; 118/657, 118/658

[56] References Cited

U.S. PATENT DOCUMENTS 4,618,243 10/1986 Knapp ..... 430/122
4,675,267 6/1987 Haneda et al. ..... 430/122

*Primary Examiner*—John L. Goodrow
*Attorney, Agent, or Firm*—Jordan B. Bierman

[57] ABSTRACT

An improved electrostatic image-developing process is disclosed, wherein said process comprises, a step of supplying a developer comprising carrier and toner to a developer transporting means which includes a cylindrical development sleeve (3) for carrying by rotation said developer (D) to the close proximity of an electrostatic latent image formed on an image-carrying member (1) disposed opposite thereto, the outer diameter of said cylindrical development sleeve (3) being 15 mm to 30 mm, and a magnetic roller (4) provided inside said cylindrical development sleeve, said roller having not less than ten magnetic poles, a step of forming a thin layer of said developer on the surface of said developer transporting means (3) so that the maximum thickness of the developer layer is smaller than the minimum distance (H) between the surface of said developer transporting means (3) and the surface of said electrostatic image-carrying member (1), a step of carrying said developer to a close proximity of the electrostatic image, and a step of forming a toner image on said electrostatic latent image-carrying member.

9 Claims, 6 Drawing Sheets

ELECTROSTATIC IMAGE-DEVELOPING PROCESS USING A MAGNETIC ROLLER

FIELD OF THE INVENTION

The present invention relates to an image developing process for developing a latent image formed on an image-carrying member, especially an image-carrying member employed in the electrophotography or the like, and in particular, to an improved image-developing process according to which the height a turf made of developer held and transported on a development sleeve.

BACKGROUND OF THE INVENTION

The current electrophotography in which an electrostatic latent image formed on an image-carrying member is visualized by development in order to obtain a final image can be generally categorized into two developing processes; a method using a one-component developer and a method using a two-component developer comprising magnetic carrier and non-magnetic toner.

Among one-component developer developing processes, especially in a developing process employing one-component, nonmagnetic developer, the force holding developer on a development sleeve solely comprises the Coulomb force and the van der waals force. Therefore, it is difficult to constantly form a uniform developer layer. Furthermore, with a developing process with one-component magnetic developer, it is difficult to obtain a brilliant color toner other than of black, since the toner usually contains magnetic substance which is black colored magnetite powder. In contrast, when compared to other developing processes, a developing process using a two-component developer can constantly form a stable developer layer and allow the use of brilliant color toner.

The developing process using a two-component developer is further categorized into two methods, the contact developing process and the non-contact developing process; in the former process, an electrostatic latent image on an image-carrying member is directly contacted with a developer layer which is in the form of turf (magnetic brush) and formed on a developer carrying member (development sleeve), thereby the toner powder adhering on magnetic carrier particles is allowed to leave the carrier and deposit on the latent image; in the latter process, an image-carrying member and a developer layer are kept in a non-contact basis, thereby a high-frequency developing bias having a direct current component is exerted to between the image-carrying member and the developer layer in order perform developing by allowing a toner to jump.

In the non-contact developing process using a two-component developer, the developing is performed without allowing a developer layer to come in contact with an image-carrying member. Therefore, this developing process is advantageous especially when forming a multi-color image, as a plurality of developing units can be disposed along the circumferential surface of the image-carrying member, thereby the corresponding number of developing steps are performed in order to form the same number of toner images on the same position of the image-carrying member.

When developing an electrostatic latent image on an image-carrying member with developer held on and transported by a development sleeve, the smaller gap between the image-carrying member and the development sleeve can enhance the contrast in obtained image, improving the image quality. In a contact developing process in which the developing is performed by allowing the developer layer to contact with the image-carrying member, the maller gap between image-carrying member and the development sleeve, however, it is necessary to limit the amount of developer being held on and transported by the development sleeve to an appropriate smaller range, in order to prevent the developer from being compacted between the image-carrying member and the development sleeve or an electrostatic latent image or developed image from being damaged by the pressure or rubbing force of developer. The term "amount of developer" means a per unit area weight of developer held on the development sleeve.

Also, in the non-contact developing process in which the developing is performed by constantly separating the image-carrying member from the developer layer, it is necessary to limit the amount of developer being held on and transported by the development sleeve to an appropriate smaller range, in order to prevent the image-carrying member from coming into contact with the developer layer.

A conventional developing process using a two-component developer performs the developer with a developing unit having, for example, the following constitution. In the similar developing unit, a development sleeve is made of a nonmagnetic cylindrical member or a non-magnetic belt, whereby to the side opposite to the image-carrying member on the development sleeve is disposed a magnet. This magnet may be either a stationary magnet or a magnet rotatable on a specific axis, according to a specific development requirement. Among the developer held on the development sleeve, the magnetic carrier receives a magnetic force derived from the magnetic field of the magnet which is in a position on the development sleeve opposite to the image-carrying member, and forms a turf, thereby the carrier is held on the development sleeve. Being agitated in a developer, the non-magnetic toner is rubbed with the magnetic carrier and acquires triboelectrical charge. This means the non-magnetic toner acquires triboelectricity of which polarity opposite to the magnetic carrier, thereby the non-magnetic toner and the magnetic carrier are bonded together by a Coulomb force. Since the magnetic carrier is held on the development sleeve by the magnetic field of the magnet, the non-magnetic toner together with the magnetic carrier is held on the development sleeve, thus the development sleeve is provided with a developer layer comprising both the magnetic carrier and the non-magnetic toner. The developer layer is held on and carried by the development sleeve and develops an electrostatic latent image formed on the iamge carrying member.

Conventionally, an ordinary development sleeve is composed of a cylinder with a diameter of approximately 50 mm and has less than eight magnetic poles. However, for example, in a color copying apparatus in which a plurality of color toner images are formed in a same position, a plurality of developing units disposed along the circumferential surface of a photosensitive drum requires a miniaturization of individual developing unit. Accordingly, a developing unit with diameter of 15 to 30 mm is advantageously used. A small diameter development sleeve naturally has a shorter circumferential length, and accordingly has a smaller number of magnetic poles; a most commonly used small diameter development sleeve comprises a rotatable magnetic roller having, in total, alternately arranged 4 to 6 N and S poles.

By such a magnetic roller, a developer layer adhering to the circumferential surface of development sleeve is transported to a development region which is facing an image-carrying member. The developer layer should satisfy the minimum criteria mentioned previously; the developer is not compacted in the gap between the image-carrying member and the development sleeves; and, the image-carrying member and the developer layer are strictly separated with each other. Furthermore, the developer layer is required to satisfy the following criteria. (1) The "fogging", which is the phenomenon where toner adheres to the surface of image-carrying member othre than in the image region, does not occur. (2) The "carrier adhesion", which is the phenomenon where carrire adheres to the surface of image-carrying member, does not occur. (3) A sufficient amount of toner being capable of providing satisfactory image density deposits on an electrostatic latent image region on the image-carrying member. (4) The toner image made of deposited toner has tones which satisfactorily reproduce the tones of electrostatic latent image. To satisfy these criteria, the following conditions should respectively satisfy a specific requirement: the physical properties of developer and a developer agitation method; the physical properties of image-carrying member and the relative velocity between the image-carrying member and the developer layer; the means for forming an electrostatic latent image on the image-carrying member; the electric bias exerted between the image-carrying member and the development sleeve; the magnetic force of magnet and the pattern of magnetic field. The requirements for satisfying the above criteria include the amount of developer on the development sleeve, the thickness of developer layer; the permissible scope of these two requirements is stricter when compared to the previously mentioned minimum criteria.

Conventionally, to achieve a required amount and thickness of developer in the developer layer held on the development sleeve, a developer layer-thickness regulating member 205 shown in FIG. 8 made of metal of resin is disposed in the close vicinity of the development sleeve 203 surface. The developer D held and travelling on the surface of development sleeve 203 by way of magnetic force passes through the gap between the developer layer-thickness regulating plate 205 and the development sleeve 203 surface, thereby the thickness of developer layer is regulated and the layer is transported to the development region.

The development sleeve 203 here is composed of a nonmagnetic cylinder having a built-in magnetic roller 204.

With a system using such a developer layer-thickness regulating plate 205, when keeping the thickness of developer D approximately at 1 mm or smaller, the gap between the developer layer-thickness regulating plate 205 and the development sleeve must be kept approximately 0.5 mm or smaller. This is because the developer D acquires a high density, when passing between the developer layer-thickness regulating plate 205 and the development sleeve 203, due to pressure with which the developer is transported, and, in contrast, after passing between the developer layer-thickness regulating plate 205 and the development sleeve 203, the developer D on the development sleeve 203 acquires a low density and rises due to the magnetic force of magnetic roller 204, thereby the thickness of developer layer formed with the same amount of developer becomes larger.

An ordinary copying apparatus or a printer, with which an electrostatic latent image is visualized by the developing process, has an image width of several hundred millimeters. Such an apparatus has a disadvantage; constantly keeping the gap between the developer layer-thickness regulating plate and the development sleeve uniformly at approximately 0.5 mm or smaller along the whole image width requires high-precision machining for the layer-thickness regulating plate and high-precision adjustment thereof, and this is not easily performed.

Additionally, the non-contact developing system using a two-component developer has a specific disadvantage; since the height of carrier turf in the development region is larger than that of the non-contact developing system using a one-component developer, it is impossible to use a smaller development gas, hence the poor reproducibility of fine lines or fine characters.

Conventionally, the non-contact developing process has poor reproducibility of fine lines or fine characters, due to an electrical field in the developing area. This is because, in a non-contact developing process, the edge electrical field generated on the edge region of an electrostatic latent image formed on an image-carrying member acts as a barrier against toner, while in a contact developing process such an electrical field attracts more toner powder. This advantage, however, is resolved by narrowing the development gap, which is the gap between the development electrode and the image-carrying member. However, in the developing process using a two-component developer, the height of carrier fur is, as mentioned previously, larger than that of a developing process using a one-component magnetic toner, and, resultingly, such a countermeasure has a limitation, as the narrower development gap means the carrier fur coming into contact with the image-carrying member.

To solve the above problems, the applicant proposed in Japanese patent Applications Nos. 34318/1986 and 31319/1986 and the like a technical means, appropriate for the noncontact developing system, for forming a developer layer on a development sleeve.

To be brief, according to the technical means, the tip of resilient plate attached to a supportive member is positioned toward the upstream side, relative to the travel of developer on a development sleeve, thereby the resilient plate is pressed onto the development sleeve in order to regulate the thickness of travelling developer composed of magnetic carrier and toner. This technique regulates the developer layer thickness to a thinner level with high-precision when compared to other, conventional developer layer-thickness regulating means.

According to the above arrangement, the developer thickness on the development sleeve is regulated with high precision when compared to a conventional developer layer-thickness regulating means. In the case of developing process using a two-component developer, however, the height of magnetic carrier turf is often larger than that of one-component magnetic toner. In addition to the occurrence of fogging by toner which was mentioned previously, the developing system using a two-component developer may also cause the problem of carrier adhesion. Therefore, when an image-carrying member is in the close vicinity of the development sleeve in order to allow the electrical field to exerts its force more strongly on the toner and carrier which respectively have a polarity reverse to that of their counterpart, and resultingly, to suppress edge-effect and to reproduce a solid black area or characters more definitely, another problem arises; the developer comes into contact with the surface of image-carrying member, and, especially with a multi-color copying system, readily causes a color mixed with another color as well as the carrier adhesion, thus deteriorated image quality.

SUMMARY OF THE INVENTION

The object of the invention is to provide a developing process which allows the use of brilliant color toner and uses a two-component developer being capable of stably forming a developer layer, and which can position an image-carrying member unconventionally closer to a development sleeve in order to stably form a uniform, high-density thin developer layer having a lower turf, which in turn allows the formation of high-quality final image.

The other object of the invention is to provide a developing process using a non-contract developing system with a two-component developer and being capable of forming a highly sharp, high-resolution image, in particular, a developing process which is provided with specific conditions for a development gap as well as a developing bias which are criteria for a high quality final image.

The above objects are attained by a developing process, whereby a developer composed of a non-magnetic toner and magnetic carrier is introduced into the gap formed between an image-carrying member and a cylindrical development sleeve which has a built-in magnetic member, by means of the rotation of magnetic member relative to the cylindrical development sleeve, thereby, to allow the toner to jump in the space on developing region in order to develop the electrostatic latent image formed on the image-carrying member, an oscillating electrical potential is applied to between the image-carrying member and the cylindrical development sleeve while the developer is not allowed to contact with the electrostatic latent image-carrying member, wherein the developing process is characterized by the cylindrical development sleeve having a diameter of 15 to 30 mm and by more than ten magnetic poles of the magnetic member which is contained in the cylindrical development sleeve.

Figure 1:
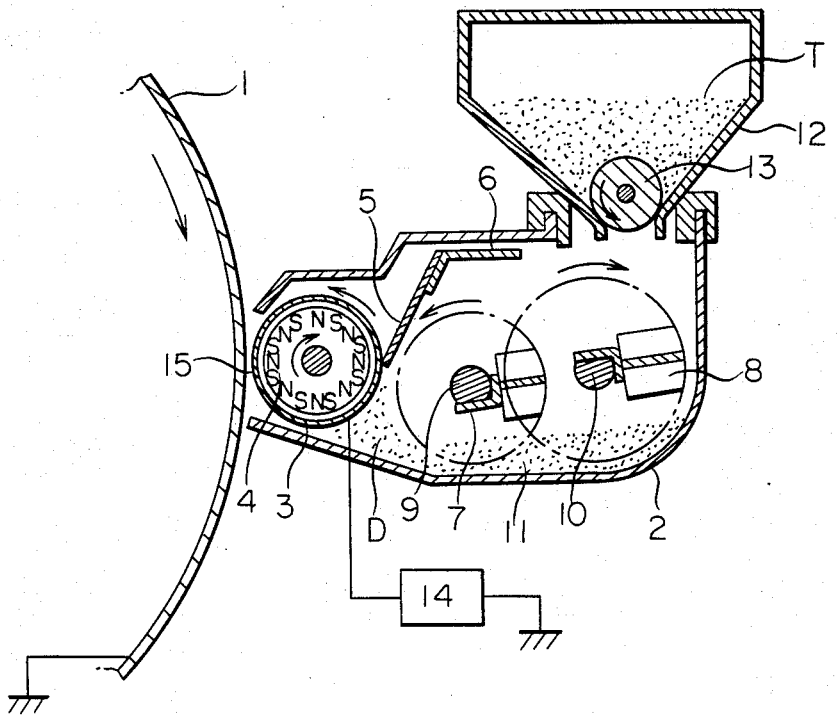
FIG. 1 illustrates a sectional view of the principal area of an example of a developing apparatus advantageously used for carrying out the present invention.

In the drawings respective numbers and symbols stand for as follows:

| | |
|---|---|
| 1 | Image-carrying member |
| 2 | Housing of development apparatus |
| 3 | Development sleeve |
| 4 | Magnetic roller |
| 5 | Developer layer-forming member |
| 205 | Developer layer-thickness regulating member |
| 7, 8 | Agitator |
| 15 | Development region |
| 26 | Laser optical system |
| 27 | Scorotron electrification charger |
| 29 | Image transfer unit |
| 30 | Separation unit |
| 31 | Fixing unit |
| 33 | Cleaning unit |
| $V_H$ | Electric potential (V) of image-carrying member in the non-image portion |
| $V_B$ | Electric potential (V) of direct current component of developing bias |
| $V_{AC}$ | Electric potential ($V_{p-p}$) of alternating current component of developing bias |
| n | Frequency of developing bias (KHz) |
| H | Development gap (mm) |
| IN | Image input |
| D | Developer |
| T | Toner |
| P | Recording sheet |

DETAILED DESCRIPTION OF THE INVENTION

Figure 2:
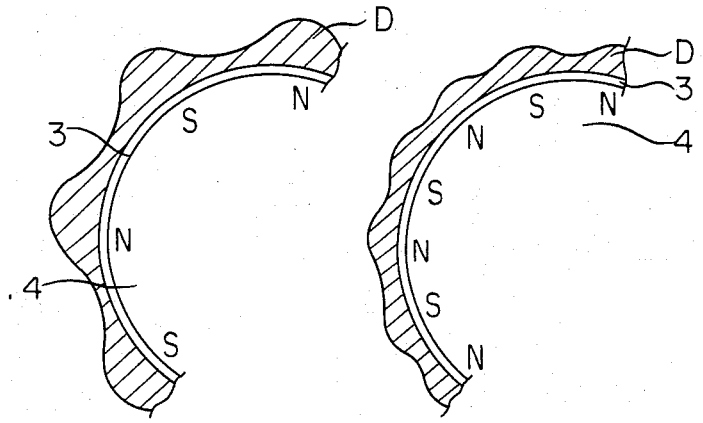
FIG. 2 illustrates a sectional view showing the status of the developer layer on the development sleeve.

The developing apparatus of the present invention has a development sleeve having a diameter of 15 to 30 mm and a magnetic roller having more than ten magnetic poles; this means the intervals between neighboring poles are smaller when compared to a conventional magnetic roller which has less than eight magnetic poles. The turf composed of carrier is higher on a magnetic pole. Correspondingly, the developer layer forms waves on the development sleeve as shown in FIG. 2. Increasing the number of magnetic poles on the magnetic roller reduces the distances between neighboring magnetic poles on the development sleeve, resulting in the denser developer layer due to a magnetic gradient which is greater in the normal line direction on development sleeve, also the developer layer thickness becomes more uniform as the wave lengths and wave heights of a wavy developer layer become smaller.

The magnetic roller rotates at a high speed, whereby the wave-formed developer layer whose stationary status shown in FIG. 2 is transported, while constantly changing its form, to a direction reverse to the magnetic roller, and reaches the developing region. Consequently, the height of carrire turf constantly varies, wherein the thickness of developer layer is determined by the height of "mountain" portion in waves of the layer.

According to the present invention, the smaller height of waves in the developer layer contributes to a more uniform thickness. This in turn allows the image-carrying member to be positioned unconventionally close to the development sleeve.

With a preferred embodiment of the invention, the effects of the invention are more advantageously attained by incorporating an arrangement which satisfies the following expression:

$$0 < \frac{|V_H - V_B|}{V_{AC}} < \frac{0.2}{nH}$$

where the electric potential of image-carrying member in the non-image portion is represented by $V_H$ (V); the electric potential of alternating current component of developing bias, $V_{AC}$ ($V_{p\text{-}p}$); the frequency of developing bias, n(KHz); the electrical potential of direct current component of developing bias, $V_B$ (V); and, the development gap, H (mm). The unit $V_{p\text{-}p}$ means a peak-to-peak value of the alternating current component in developing bias.

Figure 11A:
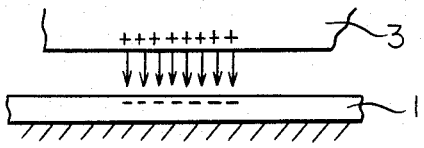
FIGS. 11(a) and 11(b) illustrate the status of electric lines force in the developing region.
Figure 11:
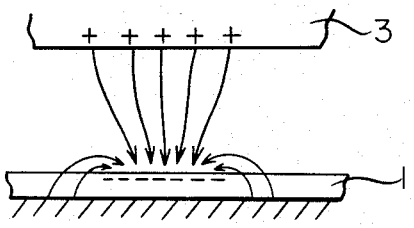

FIGS. 11(*a*) and 11(*b*) respectively illustrate the status of electric lines between an image-carrying member 1 and a development sleeve which serves as a developing electrode, in a non-contact developing system. FIG. 11(*a*) illustrates the status of electric lines with a smaller developing gap H; FIG. 11(*b*) illustrates the similar status with a larger developing gap H.

An experiment, which the inventors have performed using a non-contact developing system with a developing apparatus in which a two-component developer described later and being formed into a thin developer layer on a development sleeve, indicated the developing gap H should be within a range of 0.3 to 0.6 mm; this condition is a requirement for forming a comparatively good toner image, though not fully satisfying the image quality. The status of electric lines under such a condition is shown in FIG. 11(*b*). In oather words, with a noncontact developing system, the area, where a toner excessively deposits as a result of edge effect in a conventional contact developing system, does not attracts the toner. Accordingly, the toner does not readily deposits on the edge portion on an electrostatic latent image. Consequently, a final image lacks in sharpness, hence the poor reproduction of fine lines or characters.

The inventors performed many runs of experiments using the following developing apparatus which is suitable for forming a thin developer layer.

FIG. 1 illustrates a sectional view of a developing apparatus which is advantageous in implementing the developing process of the present invention. In the FIGURE, numeral 1 represents an image-carrying member; 2, a housing; 3, a cylindrical development sleeve; 4, a magnetic roller having a total of N and S poles; 5, a developer layer-forming member; 6, a retaining member associated with the member 5; 7, the first agitator; 8, the second agitator; 9, the rotary shaft of the agitator 7; 10, the rotary shaft of the agitator 8; 11, a developer reservoir; 12, a toner supply container; 13, a toner feeding roller; 14, a developing bias power source; 15, a development region; T, a toner; d, a developer.

With such a developing apparatus, the developer d in the developer reservoir 11 is thoroughly aditated and mixed by the first agitator 7 rotating in the arrow direction as well as by the second agitator 8 rotating the counter direction as meshed with the first agitator 7, and transported on the surface of development sleeve 3 by means of a transporting force of magnetic roller 4 whose rotation is in a direction reverse to the rotation of development sleeve 3 rotating in an arrow direction. Onto the surface of the development sleeve 3 is pressed a specific area near the tip of developer layer-forming member 6 which is supported by the retaining member extending from the housing 2, in order to regulate the layer thickness of developer d being transported, thereby the thickness, being kept small, is 100 to 500 μm, or more advantageously, 150 to 400 μm. If the thickness is less than 100 μm, the development density is excessively small; in contrast, the thickness exceeding 400 μm causes the carrier and tonre fly around in the developing apparatus. In the developing region 15, the developer layer develops, on a non-contact basis, an electrostatic latent image on the image-carrying member rotating in an arrow direction, forming a toner image. In the non-contact developing operation, a developing bias supplied from the power source 14 and having an alternating current component is applied onto the development sleeve 3. Resultingly, a toner out of the developer on the sleeve is selectively transferred onto the surface of electrostatic latent image and deposits there. Additionally, the thickness of developer is measured in the following manner. The thickness is determined by using a Nikon Profile Projector manufactured by Nippon Kogaku K.K., and by comparing the image of sleeve projected on a screen with the image of sleeve having the thin developer layer and similarly projected on a screen. The developer layer-forming member 5, which is provided with resilience as its one end is secured with the retaining member 6, is composed of an extremely uniform thin plate made of a magnetic or non-magnetic metal, metal compound, plastic, rubber or the like. The member 5 has a thickness of 50 to 500 μm.

As mentioned previously, the area adjacent to one end of the developer layer-forming member whose other end being secured softly presses the development sleeve 3. The resilient pressing force allows a layer solely composed of carrier and toner particles to pass through the location where the thin plate is in contact with the sleeve 3. This arrangement prevents foreign substances in the developer d and aggregate of carrier and/or toner from passing through the location. Consequently, the uniform developer layer is constantly and stably transported to the developing region 15.

Incidentally, the thickness of developer layer transported to the developing region 15 is controlled by deliverately changing the pressing force and angle of contact according to which the developer layer-thickness regulating member 5 presses the sleeve.

As mentioned previously, the smaller the carrier and toner particles are, the more advantageous in terms of image quality, especially, resolution and tone-reproduction of final image. With a fine-particle carrier having a particle size of smaller than 30 μm, the foreign substances as well as the aggregate are automatically rejected by a means such as previously described developer layer-forming member 5, in order to form a uniform layer. Furthermore, even if the carrier has a diameter as small as that of a toner, the above means similarly rejects foreign substances and allows the formation of uniform developer layer. The two agitators 7 and 8 incorporated into the previously described developing appratus mesh with each other and rotate in counter directions. Therefore, their agitating blades do not collide with their counterpart. This constitution ensures the thorough agitation in the left and right directions (in FIG. 1). At the same time, the inclination of agitating plates allows the thorough agitation in the depth-wise direction (in FIG. 1).

Additionally, the toner T supplied from a hopper 12 via the toner feeding rollre is uniformly blended with the developer d in a short time.

The toner d having been thoroughly agitated and adequately triboelectrically charged deposits on the developing sleeve 3 which transports it. In the course of transportation, the developer is regulated by the developer layer-forming member 5 and formed into an extremely thin uniform developer layer. While the developer layer is transported in a specific direct by the rotation of development sleeve 3, a magnetic bias having an oscillating component is generated by the rotation of magnetic roller 4 reverse to that of sleeve 3, thereby the developer on the development sleeve 3 shows complicated behavior such as rolling. Correspondingly, once the developer layer reaches the development region 15 where it develops an electrostatic latent image present on the image-carrying member 1 on the non-contact basis, the toner powder is effectively supplied to the latent image surface. As mentioned previously, since the thickness of developer layer is 100 to 450 μm, the gap between the image-carrying member 1 and the sleeve 3, or the development gap, may be reduced to approximately 300 μm so as to implement the non-contact developing system. Such a narrow developing gap enhances the electric field in the developing region 15. This arrangement in turn enables satisfactory developing, even with a smaller developing bias being applied to the sleeve 3, and, advantageously, a leak discharge by developing bias is reduced. In essence, this arrangement improves the basic quality of image obtained by the developing, in term of resolution or the like.

The narrower developing gap is effective in improving the image quality. However, since a carrier turf positioned too closely to the image-carrying member readily causes carrier adhesion onto the member, the reduction in the gap has a limitation; the smallest possible gap is approximately 300 μm, as specified above.

Under the basic conditions listed in Table 1, and using a developing apparatus similar to the above description, the inventors determined the conditions for satisfactory image reproducibility, by varying an electrical potential of alternating current component $V_{AC}$ in developing bias, electric potential of direct current component $V_B$ in developing bias, developing bias frequency nKHz, and electric potential $V_H$ of image carrying-member in the non-image portion.

TABLE 1

| | | |
|---|---|---|
| Development sleeve | External diameter | 10–40 mmϕ |
| | Revolution | 100–400 rpm |
| | Amount of adhering developer | 1–10 mg |
| Magnetic roller | Number of poles | 6–12 poles |
| | Revolution | 100–150 rpm |
| | Magnetic force (surface of sleeve) | 400–800 G |
| Surface potential on photosensitive member | | 200–1500 V |
| Processing speed | | 50–300 mm/s |
| Developing gap | | 0.3–0.6 mm |

The following were observed in the course of experiment.

(1) Preferably, $|V_H - V_B|$ should be smaller. If this value being larger, carrier adhesion on the non-image portion readily occurs. In contrast, when the value is approximately 0, fog tends to occur.

(2) The electrical potential $V_H$ is image carrying-member should be set larger in view of the fluctuation in potential level due to the aging and fatigue in the member.

(3) The larger $V_{AC}$ causes leak of potential, incurring carrier adhesion. Accordingly, the $V_{AC}$ should be set smaller.

Other than the above basic tendencies, it was learned that there is a specific interrelation among the $|V_H - V_B|$, the frequency of developing bias (KHz), the electric potential of alternating current component $V_{AC}$ and the image quality. Incidentally, $|V_H > |V_B|$ is a criterion for the reversal development process; while $|V_H > |V_B|$ is a criterion for the normal development process.

Figure 9:
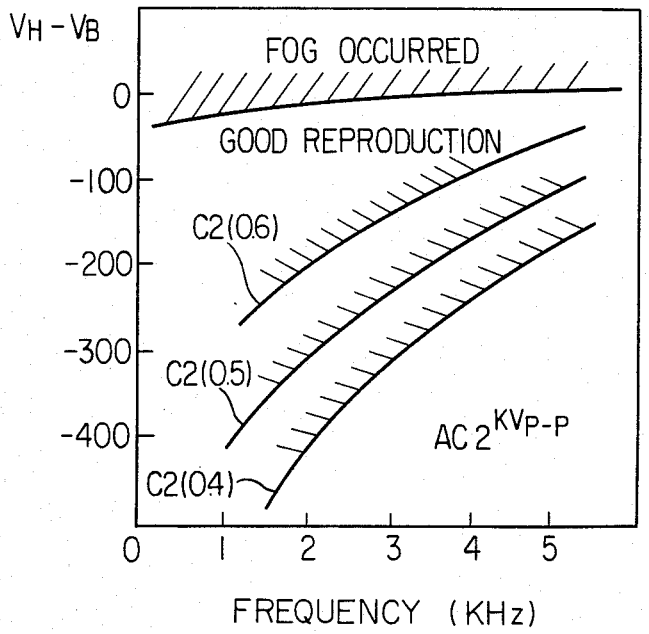
FIGS. 9 and 10 are experimental results graphically showing the image reproduction in accordance with the preferable embodiment of the present invention.

FIG. 9 illustrates the conditions which provide good image reproduction, wherein the horizontal axis represents the developing bias frequency (KHz), and the vertical axis represents $|V_H - V_B|$, and the electric potential of alternating current component of developing bias was set at 2 $KV_{p\text{-}p}$. In the FIGURE, C2(0.6), C2(0.5) and C2(0.4) respectively represent a limitation of good reproduction with a developing gap respectively of 0.6 mm, 0.5 mm and 0.4 mm.

Figure 10:
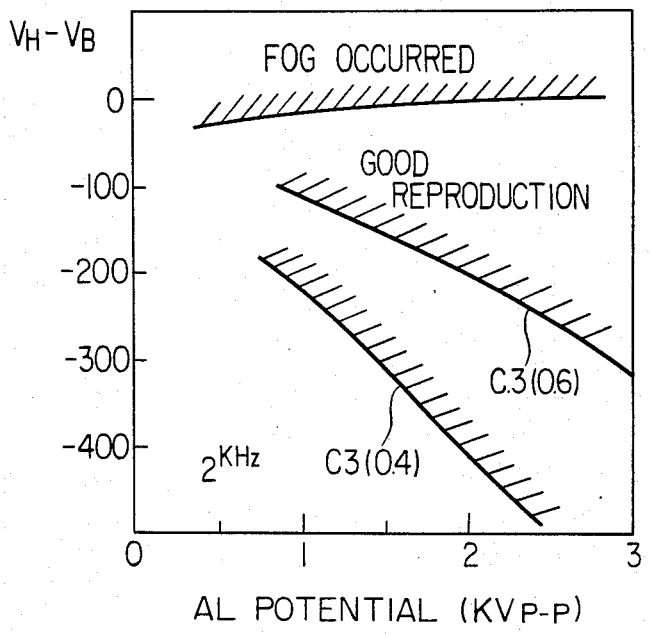

FIG. 10 illustrates the conditions which provide good image reproduction, wherein the horizontal axis represents the electric potential ($KV_{p\text{-}p}$) of alternating current component of developing bias, and the vertical axis represents $|V_H - V_B|$, and the electric potential of alternating current component of developing bias frequency was set at 2 KHz. In the FIGURE, C3(0.6) and C3(0.4) respectively represent a limitation of good reproduction with a developing gap respectively of 0.6 mm and 0.4 mm. It is apparent from the graphs in FIGS. 9 and 10 that the smaller developing gap means the wider range of good image reproduction; in FIG. 9, the lines of limitation of good reproduction denoted by C2(0.6), C2(0.5) and C2(0.4) constitute characteristic curves descending to the left; in FIG. 10, the lines of limitation of good reproduction denoted by C3 (0.6) and C2(0.4) constitute near-linear characteristic curves descending to the right.

To define the above limitation curves numerically, the range of good image reproduction was determined as $$0 < \frac{|V_H - V_B|}{V_{AC}} < F$$

whereby the value F was determined by a series of experiment. The results are listed in Table 2.

TABLE 2

| | | Value F | | | |
|---|---|---|---|---|---|
| | | Developing bias frequency (KHz) | | | |
| | | 2 | 3 | 4 | 5 |
| Developing gap (mm) | 0.3 | 0.24 | 0.19 | 0.16 | 0.11 |
| | 0.4 | 0.20 | 0.15 | 0.12 | 0.08 |
| | 0.5 | 0.15 | 0.10 | 0.08 | 0.05 |
| | 0.6 | 0.10 | 0.06 | 0.04 | 0.02 |

Furthermore, when the bias frequency is n KHz, the developing gas is H mm, and F=Fo/nH, the value Fo can be determined based on the experimental data in Table 2. Table 3 lists the determined results.

The results of varied frequency in $V_{AC}$ are s follows: in a low frequency range (lower than 1 KHz), the fog readily occurs, and the carrier adhesion occurs more frequently; in a high frequency range (higher than 5 KHz), a smaller permissible scope of value Fo makes it impossible for a developing apparatus with such a scope to satisfy requirements for actual operation, since such an apparatus fails to compensate the change in properties of a photosensitive member due to fluctuating environments. In summary, the preferred $V_{AC}$ frequency range is 1 to 5 KHz, in particular, 2 to 4 KHz.

TABLE 3

| | | Value Fo | | | |
|---|---|---|---|---|---|
| | | Developing bias frequency (KHz) | | | |
| | | 2 | 3 | 4 | 5 |
| Developing gap (mm) | 0.3 | 0.14 | 0.17 | 0.19 | 0.17 |
| | 0.4 | 0.16 | 0.18 | 0.19 | 0.16 |
| | 0.5 | 0.15 | 0.15 | 0.16 | 0.13 |
| | 0.6 | 0.12 | 0.11 | 0.10 | 0.07 |

More specifically, it was learned that the range being capable of attaining the non-contact developing process with good image reproduction satisfies the following condition:

$$0 < \frac{|V_H - V_B|}{V_{AC}} < \frac{0.20}{nH}$$

in particular, $$0 < \frac{|V_H - V_B|}{V_{AC}} < \frac{0.15}{nH}$$

more specifically, $$0 < \frac{|V_H - V_B|}{V_{AC}} < \frac{0.06}{nH}$$

The above conditions define the relation betweent he developing gap and the developing bias. Under such conditions, the edge potential, which is shown in FIG. 11(*b*), is weak, and it becomes possible to attain the sharpness and resolution of more than 8 l/mm which is regarded as a threshold being capable of satisfying the appreciation with human vision, thus complying with the criterion for actual use.

The composition of toner contained in the developer used here is as follows: (1) Thermoplastic resin (binder); 80 to 90 wt %

Ex. polystyrene, styrene-acryl polymer, polyester, polyvinyl butyral, epoxy resin, polyamide resin, polyethylene, ethylenevinyl acetate copolymer, or a mixture of any of above materials.

(2) Pigment (Colorant); 0 to 15 wt %

Ex. Black; Carbon Black

Yellow; benzidine derivative

Magenta; Rhodamine B Lake, Carmine 6B, or the like

Cyan; copper phthalocyanine, sulfonamide derivative dye or the like (3) Charge control agent; 0 to 5 wt %

Plus toner; Nigrosine-type electron-donating dye, alkoxyl amine, alkylamide, chelate, dye, quaternary ammonium salt or the like Minus toner; Electron-donating organic complex, chlorinated paraffin, chlorinated polyester, polyester with excess acid group, chlorinated copper phthalocyanine or the like (4) Fluidizing agent Ex. Colloidal silica, hydrophobic silica, silicon varnish, metal soap, nonionic surfactant or the like (5) Cleaning agent (for preventing filming by toner on photosensitive member)

Ex. Aliphatic metal salt, oxidized silicic acid having an organic group on its surface, fluorine surfactant or the like (6) Bulking agent (For improving the surface gloss of fineal image, for reducing cost of material)

Ex. Calcium carbonate, clay, talc, pigment or the like; other than these materials, a small amount of magnetic powder may be added in order to prevent the fog from occurring on the image surface or the toner from flying around in the copying apparatus.

The magnetic powder useful for such a purpose is triferric tetroxide powder, γ-ferric oxide powder, chromium dioxide powder, nickel ferrite powder, ion alloy powder or the like, each having the particle size of 0.1 to 1 mm. 0.1 to 5 wt % of such a powder is added to the toner. To keep brilliant hue, the amount of addition is preferably less than 1 wt %. The exmaples of resin suitable for a pressure-fixing toner which is fixed on a paper sheet by way of plastic-deformation under a load of approximately 20 kg/cm include a viscous resin such as wax, polyolefin, ethylene-vinyl acetate copolymer, polyurethane, rubber or the like.

A toner is prepared using the above materials in compliance with a conventional known manufacturing method.

To prepare a further favorable image in compliance with the developing process of the invention, it is desirable that the particle size of toner (weight average) is 50 to 1 μm, in particular, within a range of 15 to 1 μm. The size exceeding 15 μm results in a slightly deteriorated image quality; the size exceeding 50 μm, in particular, results in fine characters not allowing easy recognition; and, the size smaller than 1 μm causes the fogging, and the sharpness of image is lost. Incedentally, the term "particle size", or "average particle size", of toner and carrier, according to the invention, means the weight average particle size, wherein the value of weight average particle size is a value measured by a Coulter counter (manufactured by Coulter Co.). Additionally, the specific resistance of particles is determined in the following manner: particles are first poured into a vessel having a cross section of 0.50 $cm^2$, whereby the particles are slightly compacted by tapping the vessel, then a load at the rate of 1 $kg/cm^2$ is exerted upon the compacted particles to make the thickness of 1 mm, thereby an electric field of $10^2$ to $15^5$ V/cm is applied to across the load and a bottom electrode and the level of flowing current is measured to determine the diameter. The constitution of carrier is as follows. Basically, the ingredients described for toner are again used to form a carrier.

Carrier particles are composed of magnetic particles and resin are main ingredients. For better resolution as well as tone-reproducibility, the preferred particles are spherical particles, with a weight average particle size of less than 50 μm, in particular, more than 5 μm and less than 30 μm. The particle size of carrier exceeding 30 μm, in particular, 50 μm, inhibits the formation of thin developer layer, thus deteriorating developability as well as image quality. The particle size of carrier being less than 5 μm deteriorates the developability, triboelectrical electrification properties and fluidity of the developer, as well as causes the carrier particles fly around in the copying apparatus.

To prevent the carrier from adhering to the surface of photosensitive member due to the electric potential ejected by the bias voltage, or to prevent an electric potential for forming a latent image from being neutralized due to the similar bias voltage, the carrier should has a resistivity of higher than $10^8$ Ωcm, preferably, $10^{13}$ Ωcm. The more favorable carrier is an insulative-type carrier having the resistivity of higher than $10^{14}$ Ωcm.

Such a carrier is prepared by forming a resin coat on the surface of individual magnetic particles; or by distributing magnetic fine particles into resin, thereby classifying the obtained particles with a known particle size classification means.

Furthermore, a spherical carrier is prepared in the following manner:

(1) Resin-coated carrier: To select spherical particles as magnetic particles.

(2) Magnetic powder-distributed carrier: To perform sphering treatment with hot air or hot water following the formation of magnetic powder-distributed resin; or, to form a spherical magnetic powder-distributed carrier with a spray-dry process.

It is advantageous to blend the above toner and carrier at the ratio according to which the total surface area of toner powder is approximately same as that of carrier powder. For example, if the average particle size of tonre is 10 μm, and that of carrier is 20 μm, the preferred toner concentration (weight ratio of toner against the resultant developer) is 10 to 40 wt %, in particular 8 to 25 wt %.

In other words, unlike a conventional developer composed of large carrier particles individually coated with many small toner particles, the developer of the invention contains smaller carrier particles of which size almost identical with that of toner particles, and, accordingly, as mentioned above, the total surface area of toner powder is approximately same as that of carrier powder, under a preferred blending ratio.

Figure 12:
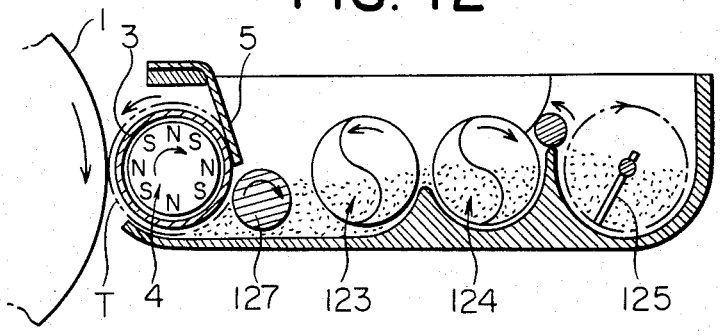
FIG. 12 illustrates a sectional view of further example of an image-forming apparatus to be used for carrying out the present invention.

In the present invention in order to effectively recover the concentration of toner in the developer on the development sleeve, especially after developing an electrostatic image having high image density, a developing unit as shown in FIG. 12, in which a developer supplying roller 127 made of resilient material is provided in close vicinity to the development sleeve 3 for the purpose of exchanging the developer, can be advantageously employed.

In FIG. 12, the developer supplying roller 127, which is made of a forming material such as urethane rubber or chloroprene rubber, is provided between development sleeve 3 and an agitation rotor 123 so that the roller is either in contact with or in close vicinity to the circumferential surface of the development sleeve 3. The developer supplying roller 127 bearing developer on its circumferential surface is made rotatable by a outer dynamic force in the same direction as that of the development sleeve at the contracting point with the development sleeve 3 bearing exhaust developer. The developer supplying roller is forcibly rotated at a different rotation rate from that of the development sleeve, whereby the exhaust developer remained on the surface of the development sleeve is peeled off and a new developer is supplied.

According to one preferable embodiment of the present invention, preferable size of the foam present in the developer supplying roller is about 0.2 mm to 1 mm and as the porous resilient material to be used may also be made, other than a urethane rubber or a chloroprene rubber, of an electrically conductive rubber and the like. When the developer supplying roller is in pressure contact with the development sleeve, the pressure to be applied is preferably such that the deforming amount of the developer supplying roller is not more than 0.2 mm and when the supplying roller is placed in the vicinity of the development sleeve the distance between the roller and the sleeve is preferably not more than 0.2 mm. The rotation frequency of the developer supplying roller is preferably 100 to 300 r.p.m.

As one of working exmaple of the invention, the advantage of the invention was successfully exerted in the developing unit as schematically shown in FIG. 12, wherein the outer diameter of the development sleeve, which is made of stainless, was 20 mm and that of the developer supplying roller was 10 mm, and the rotation frequencies with respect to the sleeve and the roller were 250 r.p.m. and 100 r.p.m., respectively. Namely, toner images with stable image density were obtained even in the repeated copying operation. [EXAMPLES]

The present invention is hereinunder more specifically described referring to the examples embodying the invention.

Prior to the description of the preferred exmaples of the invention, the experimental results which constitutes the foundation of the invention are described below.

Figure 3:
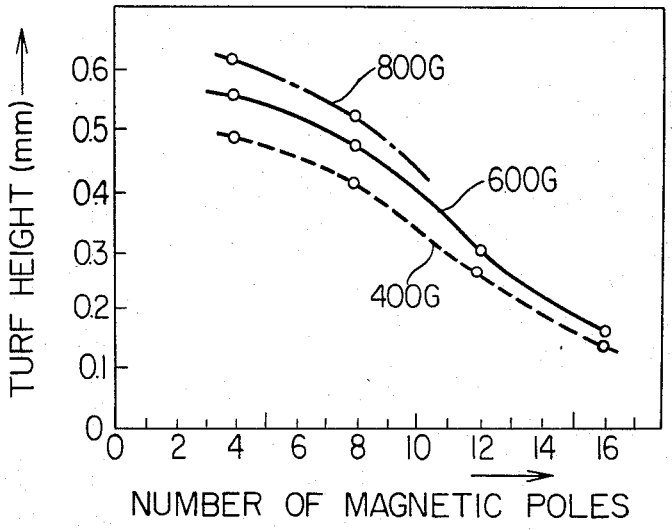
FIG. 3 shows experimental results illustrating the relation between the number of magnetic poles and the height of the turf of the developer layer.

FIG. 3 graphically illustrates the experimental results indicating the relation between the number of magnetic poles (horizontal axis) and the height of turf of the developer layer (vertical axis), wherein the magnetic force of magnetic roller is used as a parameter. The development sleeve employed in this experiment has a diameter of 20 mm, wherein magnetic poles on the magnetic roller are disposed at equal intervals. As shown in this FIGURE, the more magnetic poles the roller has, especially, more than ten poles, the increasingly lower the height of carrier turf becomes.

Figure 4:
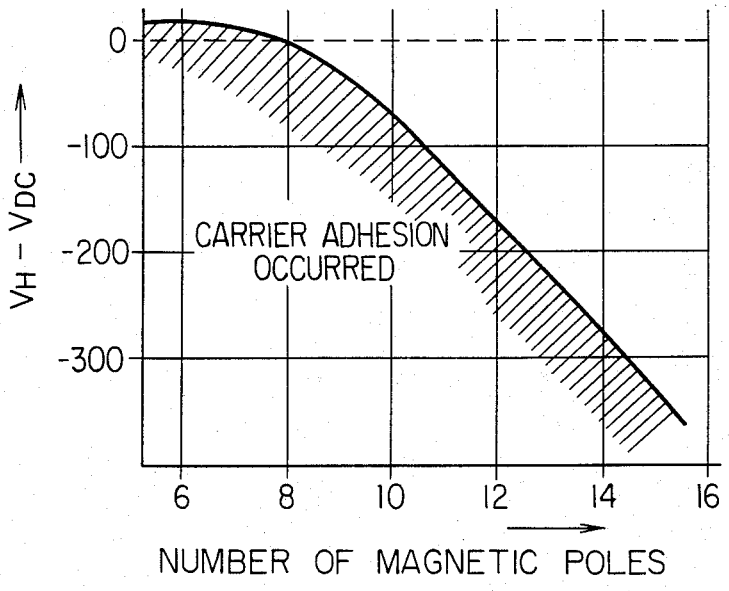
FIG. 4 shows experimental results illustrating the occurrence of carrier adhesion to the non-image portion of the electrostatic latent image-carrying member.

In the reversal development system, when the difference between an electric potential $V_H$ on the non-image portion of image-carrying member and an electric potential of direct current component $V_{DC}$ in developing bias is larger, the carrier begins to adhere also to the non-image portion on the image-carrying member. Even in this case too, increasing the number of magnetic poles on a magnetic roller can prevent the carrier adhesion. FIG. 4 illustrates the experimental results showin the occurrence of carrier adhesion to the non-image portion of the electrostatic latent image-carrying member, wherein, with the magnetization of carrier being at 15 emu/g, an image was formed using the processing conditions listed in FIG. 1. The horizontal axis represents the number of magnetic poles on magnetic roller, and the vertical axis represents the difference ($V_H - V_{DC}$) betweent he electric potential $V_H$ on the non-image portion of image-carrying member and the electric potential of direct current component $V_{DC}$ in developing bias, whereby the graph illustrates the range of carrier adhesion. In this case, an increased number of magnetic poles enlarges the permissible range of ($V_H - V_{DC}$); a magnetic roller provided with more than ten magnetic poles is advantageous for an actual use; more than 18 magnetic poles accompany difficulty in manufacturing the roller.

The range of carrier adhesion also varies depending on the intensity of carrier magnetization. The larger the carrier magnetization is, the greater is the force which makes the carrier adhere to the magnetic roller, reducing the carrier adhesion to the non-image portion, however, in spite of this, the carrier adhesion still occurs since the taller carrier turf allows the carrier to adhere to the image-carrying member more easily relative to a specific prescribed development gap. Additionally, though the smaller carrier magnetization forms a lower carrier turf, the carrier adhesion again occurs, since the attractive force from the magnetic roller (development sleeve) is small. The preferred carrier magnetization is within a range of 15 to 30 emu/g. Under these conditions, the preferred magnetization of magnet is within a range of 400 to 800 Gauss. It was learned by way of the experiment that a magnetic force of magnet greater than 800 Gauss causes a taller carrier turf, and that the magnetic force of smaller than 400 Gauss causes a spares developer layer, making it impossible to provide a satisfactory image. Furthermore, as can be expected, the size of development gap, which is a gap between the latent image-carrying member and the development sleeve, is contributable to the carrier adhesion. Therefore, it is necessary to determine both a proper carrier magnetization and a proper size of developing gap.

The above observation results occur not only in the reversal development but in the normal development. Accordingly, the above results are applicable also the latter development.

TABLE 4

| Reversal development | | |
|---|---|---|
| Processing speed | 70 mm/sec | |
| Electric potential on image-carrying member (Non-image portion) | VH = −600 V | Organic photo-sensitive member |
| Electric potential on image-carrying member (Image portion) | VL = −50 V | |
| Development gap | 0.50 mm | |
| Developing bias potential | VAC = 2 KVP-P, 4 KHz<br>VDC = −500 V | |
| Diameter of development sleeve | 200 mmϕ | |
| Revolution of development sleeve/ revolution of magnetic roller | 250 r.p.m./800 r.p.m. | |
| Magnetic force of magnet | 600 G | |
| Toner | Polyester + Carbon Black (Negative electrification) | |
| Carrier | Particle size: 30 μm, Magnetization 15 emu/g | |
| Carrier coat | MMA/st = 4/6 | |

[EXAMPLE 1]

FIG. 1 illustrates a sectional view of the principal area of one example of a developing appratus (sectional hatching omitted) according to the invention, wherein reference numeral 1 represents an image-carrying member; 2, a housing; 3, a cylindrical development sleeve; 4, a magnetic roller having a total of N and S poles; 5, a developer layer-forming member; 6, a retaining member associated with the member 5; 7, the first agitator; 8, the second agitator; 9, the rotary shaft of the agitator 7; 10, the rotary shaft of the agitator 8; 11, a developer reservoir; 12, a toner supply container; 13, a toner feeding roller; 14, a developing bias power source; 15, a development region; T, a toner; d, a developer.

With such a developing apparatus, the developer d in the developer reservoir 11 is thoroughly agitated and mixed by the first agitator 7 rotating in the arrow direction as well as by the second agitator 8 rotating in the counter direction as meshed with the first agitator 7, and transported on the surface of development sleeve 3 by means of a transporting force of magnetic roller 4 whose rotation is in a direction reverse to the rotation of development sleeve 3 rotating in an arrow direction. Onto the surface of the development sleeve 3 is pressed a specific area near the tip of development layer-forming member 6 which is supported by the retaining member extending from the housing 2, in order to regulate the layer thickness of developer d being transported, thereby the thickness, being kept small, is 100 to 500 μm, or more advantageously, 150 to 400 μm.

If the thickness is less than 10 μm, the development density is excessively small; in contrast, the thickness exceeding 500 μm causes the carrier and toner fly around in the developing apparatus. In the developing region 15, the developer layer develops, on a non-contact basis, an electrostatic latent image on the image-carrying member rotating in an arrow direction, forming a tone image. In the non-contact developing operation, a developing bias supplied form the power source 14 and having an alternating current component is applied onto the development sleeve 3. Resultingly, a toner out of the developer on the sleeve is selectively transferred onto the surface of electrostatic latent image and deposits there. Additionally, the thickness of developer is measured in the following manner. The thickness is determined by using a Nikon Profile Projector manufactured by Nippon Kogaku K.K., and by comparing the image of sleeve projected on a screen with the image of sleeve having the thin developer layer and similarly projected on a screen. The developer layer-forming member 5, which is provided with resilience as its one end is secured with the retaining member 6, is composed of an extremely uniform thin plate made of a magnetic or non-magnetic metal, metal compound, plastic, rubber or the like. The member 5 has thickness of 50 to 500 μm.

As mentioned previously, the area adjacent to one end of the developer layer-forming member, whose other end being secured, softly presses the development sleeve 3. The resilient pressing force allows a layer solely composed of carrier and toner particles to pass through the location where the thin plate is in contact with the sleeve 3. This arrangement prevents foreign substances in the developer d and aggregate of carrier and/or toner from passing through the location. Consequently, the uniform developer layer is constantly and stably transported to the developing region 15.

Incidentally, the thickness of developer layer transported to the developing region 15 is controlled by deliverately changing the pressing force and angle of contact according to which the developer layer-thickness regulating member 5 presses the sleeve.

As mentioned previously, the smaller the carrier and toner particles are, the more advantageous in terms of image quality, especially, resolution and tone-reproduction of final image. With a fine-particle carrier having a particle size of smaller than 30 μm, the foreign substances as well as the aggregate are automatically rejected by a means such as previously described developer layer-forming member 5, in order to form a uniform layer. Furthermore, even if the carrier has a diameter as small as that of a toner, the above means similarly rejects foreign substances and allows the formation of uniform developer layer. The two agitator 7 and 8 incorporated into the previously described developing apparatus mesh with each other and rotate in counter directions. Therefore, their agitating blades do not collide with their counterpart. This constitution ensures the thorough agitation in the left and right directions (in FIG. 1). At the same time, the inclination of agitating plates allows the thorough agitation in the depth-wise direction (in FIG. 1).

Additionally, the toner T supplied form a hopper 12 via the toner feeding roller is uniformly blended with the developer d in a short time.

The toner d having been thoroughly agitated and adequately triboelectrically charged deposits on the developing sleeve 3 which transports it. In the course of transportation, the developer is regulated by the developer layer-forming member 5 as well as by the magnetic roller 4 provided with an many as 10 to 16 magnetic poles, thereby the developer is formed into an extremely thin uniform developer layer. While the developer layer is transported in a specific direction by the rotation of development sleeve 3, a magnetic bias having an oscillating component is generated by the rotation of magnetic roller 4 reverse to that of sleeve 3, thereby the developer on the development sleeve 3 shows complicated behavior such as rolling. Correspondingly, once the developer layer reaches the development region 15 where it develops an electrostatic latent image present on the image-carrying member 1 on the non-contact basis, the toner powder is effectively supplied to the latent image surface. As mentioned previously, since the thickness of developer layer is 100 to 450 μm, the gap between the image-carrying member 1 and the sleeve 3, or the development gap, maybe properly reduced to a smaller value, which does not exceeds 800 μm, so as to implement the non-contact developing system. Such a narrow developing gap enhances the electric field in the developing region 15. This arrangement in turn enables satisfactory developing, even with a smaller developing bias being applied to the sleeve 3, and, advantageously, a leak discharge by developing bias is reduced.

Such a narrower developing gap, in a conventional development apparatus, lets a carrier turf come in contact with the image-carrying member and often causes carrier adhesion. Therefore, narrowing the developing gap has its own limitation.

With a developing apparatus according to the invention, even such a narrow developing gap does not cause the carrier adhesion, and, resultingly, improves the image quality as a whole including image resolution of developed final image.

Figure 5:
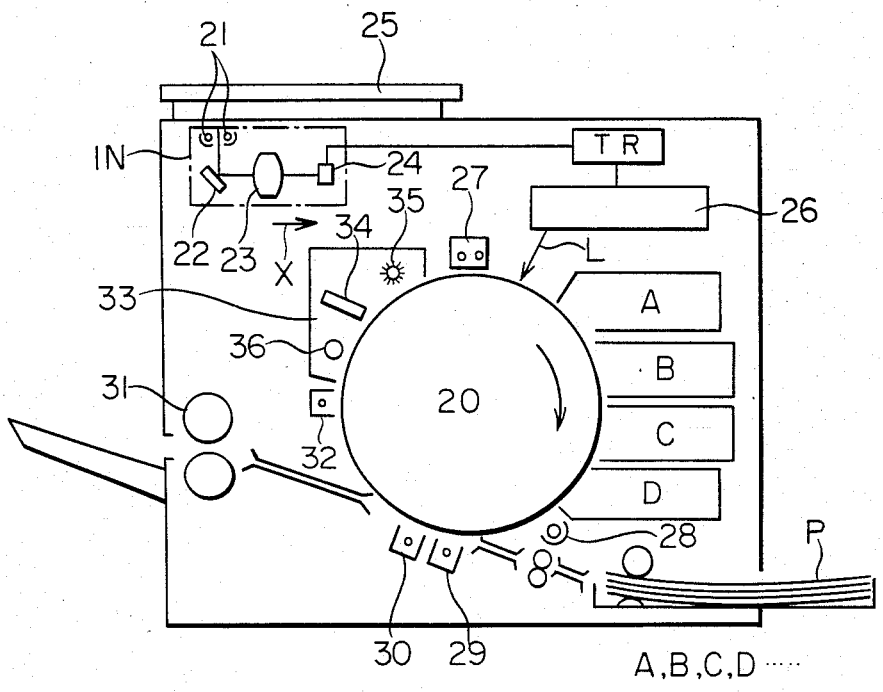
FIG. 5 illustrates a sectional view of another example of an image-forming apparatus to be used for carrying out the present invention.
Figure 6:
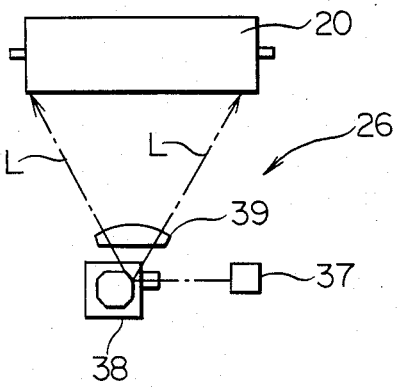
FIG. 6 illustrates a plan view of the laser optical system employed in the image-forming apparatus of FIG. 5.

FIG. 5 illustrates a constitution of an image-forming apparatus having a developing apparatus of the present invention. A unit-built image input unit IN is integrally composed of an illumination light source 21, mirror 22, lens 23, and one-dimensional color CCD image sensor 24, whereby the image input unit IN travels to an arrow X direction by means of an unshown driving unit, and the CCD image sensor 24 reads in original document. Instead of this arrangement, the document deck may be shifted to move the original document 25, while the image input unit IN remains stationary.

The image information read by the image input unit IN is converted into data suitable for recording, by an image processing unit TR.

Based on the above image data, a laser optical system 26 forms an electrostatic latent image on an image-carrying member 1 in a manner described below. Once developed, the electrostatic latent image makes a toner image on the image-carrying member 1. More specifically, a Scorotron electrification charger 27 uniformly electrifies the surface of image-carrying member 1. Next, the image-carrying member 1 is irradiated with the imagewise exposure light L which complies with recording data and transferred from the laser optical system 26 via the lens. In this way, the electrostatic latent image is formed on the image-carrying member. The electrostatic latent image is developed by a developing unit A which contains a yellow toner. The image-carrying member bearing the toner image is again uniformly electrified by the Scorotron electrification electrode 27 and irradiated with imagewise exposure light L which has recording data of another color component. The formed electrostatic latent image is developed by a developing unit B which contains a magenta toner. Resultingly, a two-color toner image composed of a yellow toner and magenta toner is formed on the image-carrying member 1. Likewise, with a cyan toner as well as a black toner, the latent image is further developed, thus a four-color toner image is formed on the image-carrying member 1. The developing units A, B, C and D respectively has a constitution identical with the developing apparatus shown in FIG. 1.

The electrical charge on multi-color toner image which has been formed in this manner is neutralized by an exposure lamp 28 for easy transfer, thereby the toner image is transferred onto a recording paper P by an image transfer unit 29. The recording paper P is separated from the image-carrying member 1 by a separation unit 30, thereby the image is fixed by a fixing unit 31. At the same time, a neutralizing unit 32 as well as a cleaning unit 33 jointly cleans the imagecarrying member 1.

The cleaning unit 33 is composed of a cleaning blade 34 and a fur brush 35. These members are not allowed to come into contact with the image-carrying member until the image-forming operation is complete. Once a multi-color image is formed on the image-carrying member 1, these members contact the image-carrying member 1 in order to scrape the residual toner remaining untransferred. Then the cleaning blade 34 leaves the image-carrying member 1. The fur brush 35 removes a toner which remains on the image-carrying member 1 even after the cleaning blade left there. Reference numeral 36 represents a roller collecting a toner scraped off by the blade 34.

Additionally, in such an image-forming apparatus, it is advantageous, for aligning an individual toner image with other toner image, to determine the timing for starting the imagewise exposure by providing an optical aligning mark which is ready by a photo-sensor or the like.

Figure 7:
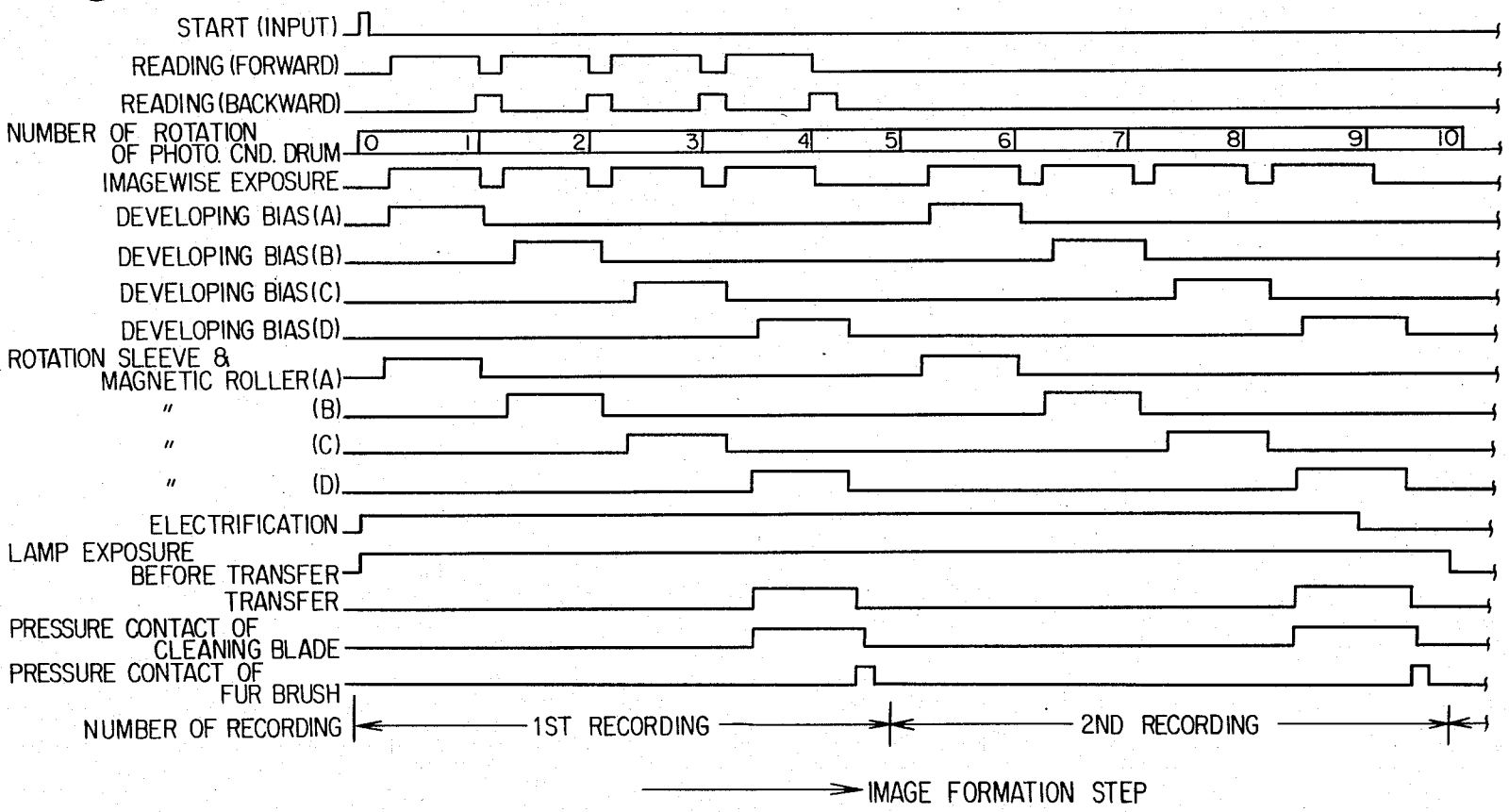
FIG. 7 is a schematic diagram illustrating the operational timings employed in the image formation process in the image-forming apparatus of FIG. 5.
Figure 8:
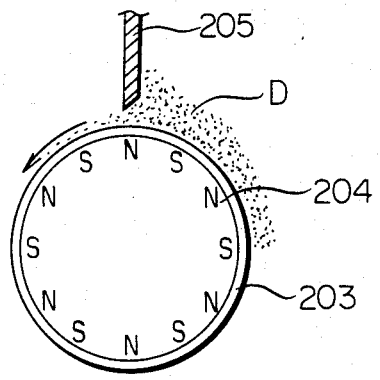
FIG. 8 illustrates a sectional view of the conventional regulation means for controlling the thickness of the developer layer.

The image-forming process with the image-forming apparatus in FIG. 5 is a reversal development using the developer having the following composition, whereby the image is formed under the operation conditions listed in Tables 4 and 7 and in conformity with the operating timing in FIG. 7. (In FIG. 7, the "high" level indicates the operating status.)

| | |
|---|---|
| (Developer composition) | |
| Toner composition: | |
| Polystyrene | 45 parts by weight |
| Polymethyl methacrylate | 44 parts by weight |
| Barifast | 0.2 parts by weight |
| (Charge controlling agent) | |
| Colorant | 10.5 parts by weight |
| Magnetite powder | 0.3 parts by weight |

The colorant, for a yellow toner, is Auramine; for a magenta toner, is Rhodamine B; for a cyan toner, copper phthalocyanine; and, for a black toner, Carbon Black. These ingredients are mixed, kneaded, and classified into a toner having a specific particle size and physical properties.

Carrier composition

Styrene-methyl methacrylate (1 : 1)
Coating substance of copolymeric resin
Ferrite particles The above ingredients are mixed, kneaded, classified then dried with hot air, thus producing a spherical toner. Eight parts weight of the above carrier and 20 parts weight of the above toner are thoroughly blended together to produce a developer.

TABLE 5

| Image-carrying member and developing unit | | Conditions |
|---|---|---|
| Image-carrying member | Photosensitive layer | Organic photosensitive layer |
| | Diameter of drum | 170 mm |
| | Peripheral speed | 70 mm/sec. |
| Electrification | Potential of non-exposure region | −650 V |
| | Potential of exposure region | −50 V |
| Imagewise exposure light L | Light source | Semiconductor laser |
| | Wave length | 780 nm |
| | Recording density | 16 dots/mm |
| Developing unit Common to developing units A, B, C and D | Development sleeve | dia. 20 mm<br>180 rpm |
| | Magnetic roller | 12 poles<br>600 rpm |
| | Flux density of development sleeve (max) | 700 G |

The organic photosensitive layer in Table 5 is a separated function-type photosensitive layer which is composed of a bottom layer serving as a carrier generating layer containing a trisazo pigment and an upper layer serving as a carrier transporting layer containing an aromatic amino compound, whereby the developing process is a non-contact developing system and at the same time a reversal developing system.

In the timing chart in FIG. 7, the horizontal axis corresponds with each image-forming step; the vertical axis, each image-forming ares. A, B, C and D respectively represent a developing unit with a yellow toner, a developing unit with a magenta toner, a developing unit with a cyan toner and a developing unit with a black toner.

A multi-color image was formed in compliance with the above conditions. The image was excellent in resolution, as well as in the reproduction of pseudo half tones. Furthermore, the flying-around of toner as well as carrier was suppressed to a minimum degree.

TABLE 6

| Developer | | Condition: Resistivity μm | Comparative resistance Ωcm | Degree of electrification μc/g | Toner concentration wt % |
|---|---|---|---|---|---|
| Carrier | | 10 | Larger than $10^{14}$ | Ferrite particles with magnetization of 20 emu/g coated with MMA/st copolymer | |
| Toner | Yellow | 10 | Larger than $10^{14}$ | 20 | 8 |
| | Magenta | 10 | Larger than $10^{14}$ | 20 | 8 |
| | Cyan | 10 | Larger than $10^{14}$ | 20 | 8 |
| | Black | 10 | Larger than $10^{14}$ | 15 | 5 |

TABLE 7

| Development | | Condition: Direct current | Alternating current | |
|---|---|---|---|---|
| Developing bias | Yellow development | −500 V | 4 KHz (Frequency) | 2 KV (Peak-to-peak) |
| | Magenta development | −500 V | 4 KHz | 2 KV |
| | Cyan development | −500 V | 4 KHz | 2 KV |
| | Black development | −500 V | 4 KHz | 2 KV |
| Non-developing bias | Common to each developing unit (With magnetic roller as well as development sleeve being stationary) | 0 V | Larger than 0.3 KV at 4 KHz | |
| Developing gap | | (Common to each developing unit) | 0.5 mm | |
| Thickness of developer layer in developing region | | (Common to each developing unit) | 300 μm | |
| Sequence of color developing | | (Yellow) → (Magenta) → (Cyan) → (Black) | | |

TABLE 8

| Other processing systems | |
|---|---|
| Transferring | Corona charge system |
| Fixing | Heat roller system |
| Cleaning | Blade and fur brush |

TABLE 9

| Image-carrying member and developing unit | | Conditions |
|---|---|---|
| Image-carrying member | Photosensitive layer | Organic photosensitive layer |
| | Diameter of drum | 170 mm |
| | Peripheral speed | 70 mm/sec. |
| Electrification | Potential of non- | −600 V |

TABLE 9-continued

| Image-carrying member and developing unit | | Conditions |
|---|---|---|
| | exposure region | |
| | Potential of exposure region | −50 V |
| Imagewise exposure light L | Light source | Semiconductor laser |
| | Wave length | 780 nm |
| | Recording density | 16 dots/mm |
| Developing unit Common to developing units A, B, C and D | Development sleeve | dia. 20 mmϕ |
| | | 250 rpm |
| | Magnetic roller | 12 poles |
| | | 1000 rpm |
| | Flux density of development sleeve (max) | 700 G |

TABLE 10

| Other processing systems | |
|---|---|
| Transferring | Corona charge system |
| Fixing | Heat roller system |
| Cleaning | Blade and fur brush |

TABLE 11

| Developer | | Condition | | | |
|---|---|---|---|---|---|
| | | Resistivity μm | Comparative resistance Ωcm | Degree of electrification μc/g | Toner concentration wt % |
| Carrier | | 40 | Larger than $10^{14}$ | Magnetite particles with magnetization of 20 emu/g coated with resin | |
| Toner | Yellow | 10 | Larger than $10^{14}$ | −15 | 8 |
| | Magenta | 10 | Larger than $10^{14}$ | −15 | 8 |
| | Cyan | 10 | Larger than $10^{14}$ | −15 | 8 |
| | Black | 10 | Larger than $10^{14}$ | −15 | 8 |

TABLE 12

| Development | | Condition | | |
|---|---|---|---|---|
| | | Direct current | Alternating current | |
| Developing bias | Yellow development | −500 v | 3 KHz (Frequency) | 2 KV (Peak-to-peak) |
| | Magenta development | −500 V | 3 KHz | 2 KV |
| | Cyan development | −500 V | 3 KHz | 2 KV |
| | Black development | −500 V | 3 KHz | 2 KV |
| Non-developing bias | Common to each developing unit (With magnetic roller as well as development sleeve being stationary) | 0 V | Larger than 0.3 KV at 4 KHz | |
| Developing gap | | (Common to each developing unit) | 0.5 mm | |
| Thickness of developer layer in developing region | | (Common to each developing unit) | 300 μm | |
| Sequence of color developing | | (Yellow) → (Magenta) → (Cyan) → (Black) | | |

Under the above specified conditions, a multi-image was formed. As a result, high-resolution, copied image having excellent color reproduction and tone reproduction was formed, like Example 1, without incurring toner/carrier flying-around. [EXAMPLE 2]

A multi-color image was formed in a manner identical with that of Example 1, except that the conditions specified in Tables 13 through 16, as well as other separately specified conditions, were complied with.

TABLE 13

| Image-carrying member and developing unit | | Conditions |
|---|---|---|
| Image-carrying member | Photosensitive layer | Organic photosensitive layer |
| | Diameter of drum | 170 mm |
| | Peripheral speed | 70 mm/sec. |
| Electrification | Potential of non-exposure region | 600 V |
| | Potential of exposure region | −50 V |
| Imagewise exposure light L | Light source | Semiconductor laser |
| | Wave length | 780 nm |
| | Recording density | 16 dots/mm |
| Developing unit Common to developing units A, B, C and D | Development sleeve | dia. 20 mmϕ |
| | | 180 rpm |
| | Magnetic roller | 12 poles |
| | | 800 rpm |
| | Flux density of development sleeve (max) | 700 G |

TABLE 14

| Developer | | Condition | | | |
|---|---|---|---|---|---|
| | | Resistivity μm | Comparative resistance Ωcm | Degree of electrification μc/g | Toner concentration wt % |
| Carrier | | 10 | Larger than $10^{14}$ | Ferrite particles with magnetization of 20 emu/g coated with MMA/st copolymer | |
| Toner | Yellow | 10 | Larger than $10^{14}$ | −20 | 8 |

TABLE 14-continued

| Developer | Condition: Resistivity μm | Comparative resistance Ωcm | Degree of electrification μc/g | Toner concentration wt % |
|---|---|---|---|---|
| Magenta | 10 | Larger than $10^{14}$ | −20 | 8 |
| Cyan | 10 | Larger than $10^{14}$ | −20 | 8 |
| Black | 10 | Larger than $10^{14}$ | −15 | 5 |

TABLE 15

| Development | | Condition: Direct current | Alternating current | |
|---|---|---|---|---|
| Developing bias | Yellow development | −500 V | 4 KHz (Frequency) | 2 KV (Peak-to-peak) |
| | Magenta development | −500 V | 4 KHz | 2 KV |
| | Cyan development | −500 V | 4 KHz | 2 KV |
| | Black development | −500 V | 4 KHz | 2 KV |
| Non-developing bias | Common to each developing unit | 0 V | Larger than 0.3 KV at 4 KHz | |
| (With magnetic roller as well as development sleeve being stationary) or floating. | | | | |
| Developing gap | | (Common to each developing unit) | 0.5 mm | |
| Thickness of developer layer in developing region | | (Common to each developing unit) | 300 μm | |
| Sequence of color developing | | (Yellow) → (Magenta) → (Cyan) → (Black) | | |

TABLE 16

| Other processing systems | |
|---|---|
| Transferring | Corona charge system |
| Fixing | Heat roller system |
| Cleaning | Blade and fur brush |

As mentioned above, a multi-color image was formed under the conditions listed in Tables 13 through 16. The above specified conditions respectively satisfied the conditions in Table 1, and especially satisfied the following conditions;

| | |
|---|---|
| $V_H = -650$ V | $V_B = -500$ V |
| $V_{AC} = 2000$ Vp−p | n = 4 KHz |
| H = 0.5 mm | |

The above conditions were specifically selected in order to satisfy the range of good image reproduction which the invention proposes. A multi-color image was formed in compliance with the above conditions. The image was excellent in resolution, as well as in the reproduction pf pseudo half tones. Furthermore, the flying-around of toner as well as carrier was suppressed to a minimum degree. [EXAMPLE 3]

Next, a multi-color image was formed in a manner identical with that of Example 2, except that 0.4 parts by weight of Barifast which is one toner ingredient was used and that the conditions specified in Tables 17 through 20 were complied with.

TABLE 17

| Image-carrying member and developing unit | | Conditions |
|---|---|---|
| Image-carrying member | Photosensitive layer | Organic photosensitive layer |
| | Diameter of drum | 170 mm |
| | Peripheral speed | 70 mm/sec. |
| Electrification | Potential of non-exposure region | −600 V |
| | Potential of exposure region | −50 V |
| Imagewise exposure light L | Light source | Semiconductor laser |
| | Wave length | 780 nm |
| | Recording density | 16 dots/mm |
| Developing unit Common to developing units A, B, C and D | Development sleeve | dia. 20 mmϕ 250 rpm |
| | Magnetic roller | 12 poles 1000 rpm |
| | Flux density of development sleeve (max) | 700 G |

TABLE 18

| Developer | | Condition: Resistivity μm | Comparative resistance Ωcm | Degree of electrification μc/g | Toner concentration wt % |
|---|---|---|---|---|---|
| Carrier | | 40 | Larger than $10^{14}$ | Magnetite particles with magnetization of 20 emu/g coated with resin | |
| Toner | Yellow | 10 | Larger than $10^{14}$ | −15 | 8 |
| | Magenta | 10 | Larger than $10^{14}$ | −15 | 8 |
| | Cyan | 10 | Larger than $10^{14}$ | −15 | 8 |
| | Black | 10 | Larger than $10^{14}$ | −15 | 8 |

TABLE 19

| Development | | Condition: Direct current | Alternating current | |
|---|---|---|---|---|
| Developing bias | Yellow development | −500 V | 3 KHz (Frequency) | 2 KV (Peak-to-peak) |
| | Magenta development | −500 V | 3 KHz | 2 KV |
| | Cyan development | −500 V | 3 KHz | 2 KV |
| | Black development | −500 V | 3 KHz | 2 KV |
| Non-developing bias | Common to each developing unit | 0 V | Larger than 0.3 KV at 3 KHz | |
| (With magnetic roller as well as development sleeve being stationary) or floating. | | | | |
| Developing gap | | (Common to each developing unit) | 0.5 mm | |
| Thickness of developer layer in developing region | | (Common to each developing unit) | 300 μm | |

TABLE 19-continued

| Development | Condition: Direct current | Condition: Alternating current |
|---|---|---|
| Sequence of color developing | (Yellow) → (Magenta) → (Cyan) → (Black) | |

TABLE 20

| Other processing systems | |
|---|---|
| Transferring | Corona charge system |
| Fixing | Heat roller system |
| Cleaning | Blade and fur brush |

As mentioned above, a multi-color image was formed under the conditions listed in Tables 17 through 20. The above specified conditions respectively satisfied the conditions in Table 1, and especially satisfied the following conditions;

| | |
|---|---|
| $V_H = -600$ V | $V_B = -500$ V |
| $V_{AC} = 2000$ Vp−p | n = 3 KHz |
| H = 0.5 mm | |

The above conditions were specifically selected in order to satisfy the range of good image reproduction which the invention proposes. Under the above specified conditions, a multiimage was formed. As a result, a high-resolution, copied image having excellent color reproduction and tone reproduction was formed, like Example 2, without incurring toner/ carrier flying-around.

As can be understood from the above descriptions, the developing process using a developing apparatus of the invention is capable of transporting a developer which is kept in a high-density status, while the height of carrier turf is suppressed low. Accordingly, even with a narrower gap between the image-carrying member and the development sleeve, the carrier adhesion to the image-carrying member does not occur, at te same itme, a sufficient amount of developer is supplied to the developing region. As a result, a high-quality image having high-density is formed with high-resolution. Additionally, as mentioned in Examples, the present invention provides a developing process which is employed in a compact, noncontact developing type image-developing unit; this type of developing unit in turn realizes a simple color image-forming apparatus.

Furthermore, when performing a developing operation, under the specified conditions of developing gap as well as developing bias, in accordance with an example advantageously embodying the developing-process of the invention, the electric potential exerts smaller influence on the edge portion on an image, resulting in the improved reproduction of fine lines and fine characters, hence the excellent image quality. At the same time, as mentioned in Examples, when a plurality of developing units, to which the developing process of the invention being applied, are disposed along the circumferential surface of image-carrying drum on a color image-forming apparatus, it is possible to form a plurality of individual color toner images on a specific position on the image-carrying member and transfer these images in a single step on a transfer paper. This arrangement not only provides a compact color image-forming apparatus but forms a copied image with highresolution, excellent tone reproduction and toner reproduction.

What is claimed is:

1. An electrostatic image-developing process comprising, a step of supplying a developer comprising carrier and toner to a developer transporting means which includes a cylindrical development sleeve for carrying by rotation said developer to the close proximity of an electrostatic latent image formed on an image carrying member disposed opposite thereto, the outer diameter of said cylindrical development sleeve being 15 mm to 30mm, and a magnetic roller provided inside said cylindrical development sleeve, said roller having not less than ten magnetic poles, a step of forming a thin layer of said developer on the surface of said developer transporting means so that the maximum thickness of the developer layer is smaller than the minimum distance between the surface of said developer transporting means and the surface of said electrostatic image carrying member, a step of carrying said developer to a close proximity of the electrostatic image, and a step of forming a toner image on said electrostatic latent image carrying member.

2. The process of claim 1, wherein the magnetic roller is made rotate during the process.

3. The process of claim 1, wherein the process is carried out while applying an oscillating electric field as developing bias.

4. The process of claim 2, wherein the process is carried out while applying an oscillating electric field as developing bias.

5. The process of claim 3, wherein said developing bias comprises direct current component and alternating current component.

6. The process of claim 4, wherein said developing bias comprises direct current component and alternating current component.

7. The process of claim 3, wherein the process is carried out while satisfying the following condition;

$$0 < \frac{|V_H - V_B|}{V_{AC}} < \frac{K}{nH}$$

wherein, $V_H$ represents electric potential of said image carrying member in the non-image portion, $V_B$ represents electric potential of direct current component of said developing bias, $V_{AC}$ represents electric potential of alternating component of said developing bias, n represents frequency of said developing bias, H represents development gap expressed in terms of the distance between surface of said image-carrying member and the surface of said development sleeve and K is a constant not more than 0.2.

8. The process of claim 7, wherein the magnetic roller is made rotate.

9. The process of claim 8, wherein said developing gap is 0.3 mm to 0.6 mm.

* * * * *